US011859817B2

(12) United States Patent
Vartak et al.

(10) Patent No.: US 11,859,817 B2
(45) Date of Patent: Jan. 2, 2024

(54) SYSTEM AND METHOD FOR LASER IGNITION OF FUEL IN A COAL-FIRED BURNER

(71) Applicant: GENERAL ELECTRIC COMPANY, Schenectady, NY (US)

(72) Inventors: Sameer Dinkar Vartak, Bangalore (IN); Sreenivasa Rao Gubba, Bangalore (IN); Kamesh Lakshmi Narayanan, Chennai (IN); Arun Kumar Sridharan, Bengaluru (IN); Ankur Maheshwari, Ahmedabad (IN); Dragisa Ristic, Wendlinger am Neckar (DE); Moorthi Subramaniyan, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 383 days.

(21) Appl. No.: 17/113,275

(22) Filed: Dec. 7, 2020

(65) Prior Publication Data

US 2022/0178539 A1 Jun. 9, 2022

(51) Int. Cl.
*F23Q 13/00* (2006.01)
*F23Q 7/02* (2006.01)
(Continued)

(52) U.S. Cl.
CPC ..... *F23Q 13/005* (2013.01); *F23Q 7/02* (2013.01); *F23C 3/002* (2013.01); *F24B 15/005* (2013.01); *F24D 7/00* (2013.01); *F24D 19/10* (2013.01)

(58) Field of Classification Search
CPC ..... F23Q 13/005; F23Q 7/02; F23C 3/002; F23C 2700/063; F23C 2900/99003; F24B 15/005; F24D 7/00; F24D 19/10
(Continued)

(56) References Cited

U.S. PATENT DOCUMENTS 5,497,612 A * 3/1996 Few ..... F23Q 13/00 60/776
5,515,681 A * 5/1996 DeFreitas ..... F23D 11/42 60/39.821
(Continued)

FOREIGN PATENT DOCUMENTS

CA 2207696 A1 * 6/1997 ..... F02P 23/04
CN 2747478 Y 12/2005
(Continued)

OTHER PUBLICATIONS

"WO_2009092236_A1_l—Machine Translation.pdf", machine translation, Clarivate Analytics. (Year: 2023).*
(Continued)

*Primary Examiner* — Steven B McAllister
*Assistant Examiner* — Daniel E. Namay
(74) *Attorney, Agent, or Firm* — Grogan, Tuccillo & Vanderleeden LLP

(57) ABSTRACT

A system and method of igniting a coal air-fuel mixture, including a burner having a burner tube operable to carry a flowing mixture of fuel and air to a furnace for combustion therein and a first flow directing device disposed within the tube, operable to direct a first portion of the flowing fuel and air mixture to a location in the burner tube. The system also includes a laser igniter within the burner tube, the laser igniter including a laser tube having a first end with a laser light input and a second end with a light output, and a laser light source operably coupled to the laser light input. The laser light source, including a laser. The laser ignitor directing photons from the light output at the location in the burner tube to ignite at least a part of the first portion of the fuel.

20 Claims, 3 Drawing Sheets

(51) Int. Cl.

| | |
|---|---|
| *F23C 3/00* | (2006.01) |
| *F24B 15/00* | (2006.01) |
| *F24D 7/00* | (2022.01) |
| *F24D 19/10* | (2006.01) |

(58) Field of Classification Search
USPC ..... 431/2, 6
See application file for complete search history.

(56) References Cited

U.S. PATENT DOCUMENTS

| | | | | |
|---|---|---|---|---|
| 5,590,517 | A * | 1/1997 | DeFreitas | F23Q 13/00 60/776 |
| 5,769,621 | A * | 6/1998 | Early | F23Q 13/00 60/776 |
| 6,382,957 | B1 * | 5/2002 | Early | F02P 23/04 431/258 |
| 6,394,788 | B1 * | 5/2002 | Early | F02P 23/04 372/71 |
| 6,413,077 | B1 * | 7/2002 | Early | F02P 23/04 431/258 |
| 6,453,660 | B1 * | 9/2002 | Johnson | F23R 3/286 60/39.821 |
| 7,303,388 | B2 | 12/2007 | Joshi et al. | |
| 7,491,300 | B2 * | 2/2009 | Hunt | F23Q 13/00 431/1 |
| 10,473,327 | B2 | 11/2019 | Ristic et al. | |
| 2011/0185996 | A1 * | 8/2011 | Kraus | F02P 23/04 123/143 B |

FOREIGN PATENT DOCUMENTS

| | | | | |
|---|---|---|---|---|
| CN | 101216172 | A | 7/2008 | |
| CN | 101216184 | A | 7/2008 | |
| CN | 101216185 | A | 7/2008 | |
| CN | 201170548 | | 12/2008 | |
| CN | 101363391 | A | 2/2009 | |
| CN | 208885262 | U | 5/2019 | |
| EP | 3469264 | | 4/2019 | |
| JP | 2006234634 | A | 10/2009 | |
| JP | 2017089908 | A | 5/2017 | |
| WO | 2009033835 | A1 | 3/2009 | |
| WO | 2009092236 | A1 | 7/2009 | |
| WO | 2009143725 | | 12/2009 | |
| WO | WO-2022126074 | A1 * | 6/2022 | F23Q 13/005 |

OTHER PUBLICATIONS

PCT International Search Report dated Mar. 14, 2022 from corresponding International Application No. PCT/US2021/072700 filed Dec. 2, 2021.

* cited by examiner

SYSTEM AND METHOD FOR LASER IGNITION OF FUEL IN A COAL-FIRED BURNER

TECHNICAL FIELD

Embodiments, as described herein, generally relate to evaluation and control methods and systems for laser ignition of coal. More particularly, a method of and system for controlling the ignition and combustion of fuel in a coal-fired boiler system.

BACKGROUND

A boiler typically includes a furnace in which fuel is burned to generate heat to produce steam. The combustion of the fuel creates thermal energy or heat, which is used to heat and vaporize a liquid, such as water, which makes steam. The generated steam may be used to drive a turbine to generate electricity or to provide heat for other purposes. Fossil fuels, such as pulverized coal, natural gas, and the like are conventional fuels used in many combustion systems for boilers. When combusting the fuel, heat is generated, and soot, as well as flue gases, are formed.

Today's power market is shifting from baseload to cyclic and peak loading brought on by increasing the participation of renewable energy sources. The emerging challenge facing many grid systems is grid stability associated with the sudden and cyclic electrical production profile of such renewable energy sources. As more and more renewable energy sources are added to the grid, there will be a greater need for the operation of fossil fuel-fired power plants at low power and/or improve fast starting to assist in stabilizing the grid. Enabling plants to operate at partial load for longer times and to have multiple cold starts will allow greater penetration of renewable power into the grid and reduce the stress and fatigue in components due to load cycling. However, operating plants at low power and making large plants more responsive to load variations presents challenges. For example, large power plants present large thermal masses, which require time to heat and have limited thermal gradient capability. Moreover, for coal-fired combustion at low plant loads, burner flame stability degrades.

To ensure operability under low power conditions, in many instances, additional support or starting flame is generated by burning oil. However, oil ignitors present several problems that are enhanced due to the operational profile of coal plants today. For example, increased corrosion due to sulfur presence in oil, increased complexity of logistics because the plant has to maintain ample storage of flammable oil or natural gas, and increased operational costs.

In some systems, plasma-ignitors have been commercially deployed to overcome the need for oil-based igniters to generate a flame. These ignitors ignite coal directly with the help of multiple ignition stages and maintain the flame across the full spectrum of air/fuel ratios and fuel flow levels. In plasma ignitors, a high voltage source (present in the ignition region) creates a plasma (highly energetic charged gaseous ions). The plasma impinges upon the coal particles, causing them to heat up and eventually ignite. However, plasma ignitors also present challenges that lead to higher costs. For example, plasma igniters require high auxiliary-power requirements (120-150 kW), medium-voltage electric cables with significant electrical insulation, bulky equipment, frequent replacement of eroding electrodes, and an ignition lance with higher-than-desired obstruction to coal flow.

Therefore, what is desired is a new method and system for generating additional support or starting flame without the need for oil or complex plasma igniters.

BRIEF DESCRIPTION

In one embodiment, a combustion burner assembly is disclosed. The combustion burner assembly comprises: a fuel source; a furnace; a fuel transport tube to transport fuel from the fuel source to the furnace; and a laser igniter configured to ignite the fuel carried through the fuel transport tube to the furnace, the laser igniter including: a laser source; a laser tube to deliver a beam of laser light from the laser source to the fuel in the fuel transport tube; and an ignition tube disposed within the fuel transport tube to receive a portion of fuel flowing through the fuel transport tube, wherein the beam of laser light heats and ignites the fuel in the ignition tube, wherein the ignition of the fuel in the ignition tube occurs in a multiple of ignition stages.

In another embodiment, a system is disclosed. The system comprises: a coal fuel source; an air source; a furnace; a fuel transport tube to transport a mixture of coal from the coal fuel source and air from the air source to the furnace for combustion thereof; and a laser igniter configured to ignite the mixture of coal and air carried through the fuel transport tube to the furnace, the laser igniter including: a laser source; a laser tube to deliver a beam of laser light from the laser source to the mixture of coal and air in the fuel transport tube, wherein a portion of the laser tube is disposed within the fuel transport tube; and an ignition tube disposed within the fuel transport tube to receive a portion of the mixture of coal and air flowing through the fuel transport tube, wherein an inlet of the ignition tube is separated from the portion of the laser tube disposed in the fuel transport tube by a predetermined spacing, wherein the beam of laser light heats and ignites the mixture of coal and air in the predetermined spacing and in the ignition tube in a multiple of ignition stages. The system further comprises a plurality of flow directing devices, wherein each of the flow directing devices is configured to direct a portion of the flow of the mixture of coal and air to flow about the ignition tube for irradiation by the beam of laser light.

In still another embodiment, a method of igniting fuel for combustion in a burner assembly is disclosed. The method comprises: transporting a flow of a mixture of fuel from a fuel source and air from an air source to a furnace with a fuel transport tube; directing a portion of the flow of the mixture of the fuel and air through an inlet of an ignition tube placed within the fuel transport tube; directing a beam of laser light towards the mixture of the fuel and air carried through the ignition tube; heating and igniting the mixture of the fuel and air carried through the ignition tube in a multiple of stages; and supplying the heated and ignited mixture of the fuel and air from the ignition tube to the furnace.

Additional features and advantages are realized through the techniques of the present disclosure. Other embodiments and aspects of the disclosure are described in detail herein. For a better understanding of the disclosure with its advantages and the features, refer to the description and the drawings as provided herein.

DRAWINGS

The described embodiments will be better understood from reading the following description of non-limiting embodiments, with reference to the attached drawings, wherein below:

DETAILED DESCRIPTION

Figure 1:
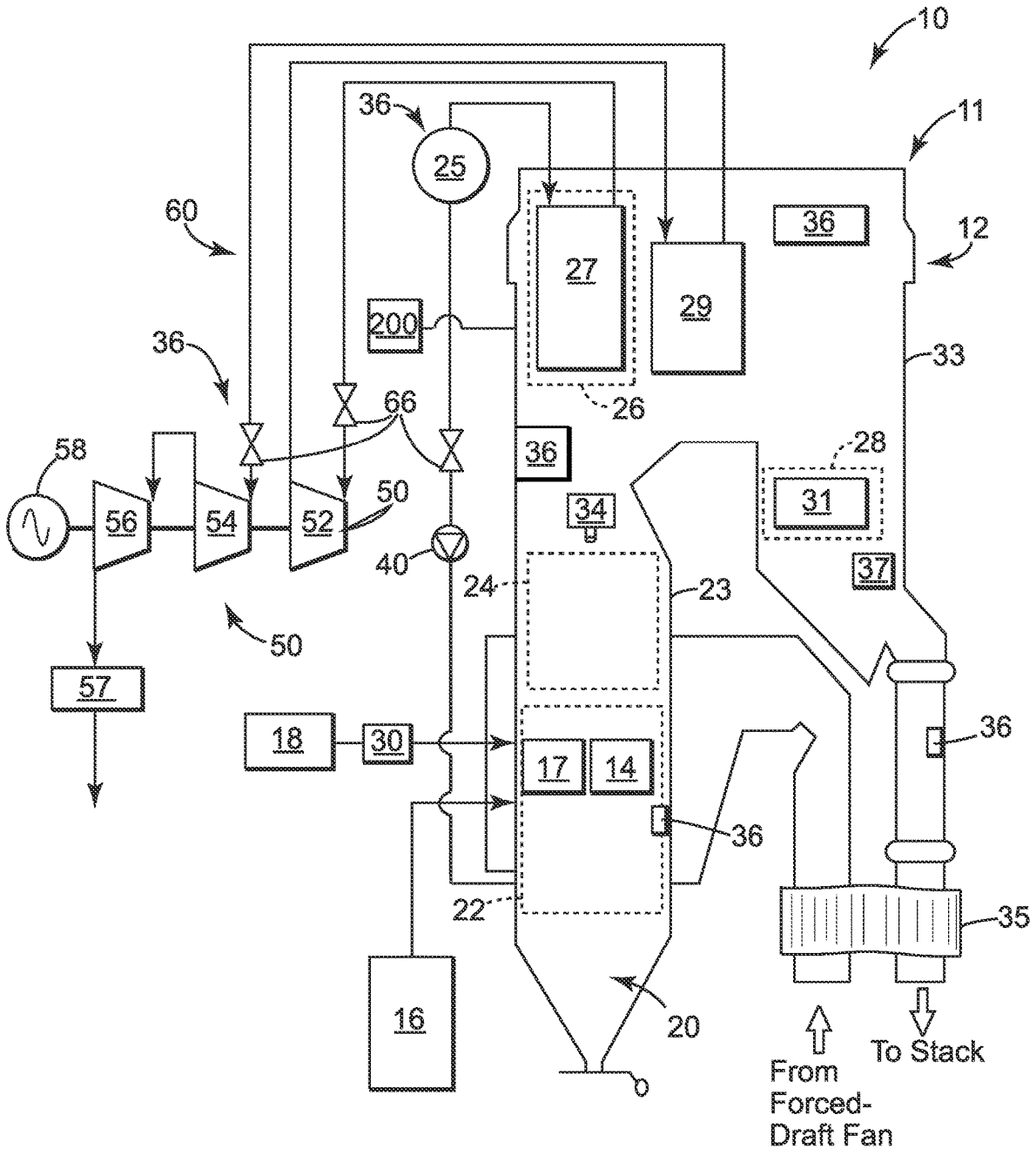
FIG. 1 is a simplified schematic illustration of a power generation system with a boiler and ignition system in accordance with an embodiment.

Reference will be made below in detail to exemplary embodiments as described herein, examples of which are illustrated in the accompanying drawings. Wherever possible, the same reference characters used throughout the drawings refer to the same or like parts. While the various embodiments are described herein with reference to a pulverized coil boiler in heat recovery steam generation systems, such reference is merely illustrative. Generally, the described embodiments are applicable to any application of a fuel-fired combustion system, including, but not limited to, a pulverized coal burner as may be utilized in a pulverized coal power plant. Other systems may include different types of plants employing coal-fired combustion systems, including, but not limited to, chemical plants, power generation plants, as well as boilers, furnaces, and fired heaters utilizing a wide range of fuels including, but not limited to, coal. For example, contemplated boilers include, but are not limited to, both T-fired and wall fired pulverized coal boilers, circulating fluidized bed (CFB) and bubbling fluidized bed (BFB) boilers, stoker boilers, suspension burners for biomass boilers, including controlled circulation, natural circulation, and supercritical boilers and other heat recovery steam generation systems.

Embodiments, as described herein, relate to a power generation system having a combustion system and a laser-based ignition and control scheme therefor. In particular, a method for generating a starting flame and additional flame support without the need for oil or the complexity of plasma ignition. In an embodiment, the flame is generated inside a custom-designed coal burner in which high-power laser beams are impinged upon flowing pulverized coal particles. The particle's temperature increases by absorption of photons from the laser, and it ignites after reaching the required critical temperature. Further, the energy released from individual particle ignition events is absorbed by neighboring coal particles. These particles also heat up and ignite. This cascading process continues until a stable flame is generated.

FIG. 1 illustrates a power generation system 10 with combustion system 11 having a boiler 12 as may be employed in power generation applications in accordance with the several embodiments. The boiler 12 may be a tangentially fired boiler (also known as a T-fired boiler) or wall fired boiler. Fuel and air are introduced into the boiler 12 via the burner assemblies 14 and/or nozzles associated therewith. The combustion system 11 includes a fuel source such as, for example, a pulverizer 16 that is configured to grind fuel such as coal to a desired degree of fineness. The pulverized coal is passed from the pulverizer 16 to the boiler 12 using primary air. An air-source 18 supplies primary, secondary, or combustion air to the boiler 12 where it is mixed with the fuel and combusted. Where the boiler 12 is oxy-fired, the air source 18 may be an air separation unit that extracts oxygen from an incoming air stream or directly from the atmosphere. In an embodiment, the burner assembly(ies) 14 includes a fuel source from the pulverizer 16 and laser igniter 17, as will be described in further detail herein. Laser igniter 17 includes, but is not limited to, a power supply and cooling systems for the high power laser, a high power laser, and a mechanism such as an optical fiber to carry the light to the burner location. The laser igniter 17 and a laser tube deliver the laser light to the flowing pulverized coal for ignition as well as flame stability, as will be described further herein. The laser light would be guarded to take precautions to avoid any of any accidental leakage of the high-power radiation.

The boiler 12 includes a hopper zone 20 located below a main burner zone 22 from which ash may be collected for subsequent removal. The bottom of the boiler 12 may be provided with a grid, that serves two purposes. First, the grid is utilized for introducing combustion, suspending, or fluidizing gas (for bed-type boilers) called primary air or combustion air that is pumped into the boiler 12 by a fan 34 via the air preheater 35. Second, the grid facilitates removing bottom ash and other debris from the boiler 12. The boiler 12 also includes a main burner zone 22 (also referred to as a windbox) where the air and an air-fuel mixture is introduced into the boiler 12, a burnout zone 24 where any air or fuel that is not combusted in the main burner zone 22 gets burned.

Furthermore, the boiler 12 includes a superheater zone 26 with superheater 27 where the combustion flue gases can superheat steam and an economizer zone 28 with an economizer 31 where water can be preheated before entering a mixing sphere or drum 25. In the main burner zone 22, controlled flows of primary air, pulverized coal, and secondary air, are introduced into the combustion system 11 to effect the formation therein of a rotating fireball. The boiler feedwater entering the economizer 31 originates from the use in the steam turbine 50 and a condenser 57 downstream of the steam turbines 50. The condensate is first heated by steam utilizing one or more low-pressure preheaters (not shown) before entering the economizer 31. Pumps 40 may be employed to aid in circulating water to the waterwall 23 and through boiler 12.

Combustion of the fuel with the primary and secondary air within the boiler 12 produces a stream of flue gases that are ultimately treated and exhausted through a stack downstream from the economizer zone 28. The often final step of collecting heat from the flue gases takes place in the combustion air preheater 35, where the flue gas heat is used to heat the air that is used as combustion air in the combustion system 11. The air preheater 35 is followed in the flue gas path by an electrostatic filter/precipitator or a bag filter (not shown) that separates any solid particles left in the flue gases before the flue gases are vented to the atmosphere via a stack. As used herein, directions such as "downstream" means in the general direction of the flue gas flow. Similarly, the term "upstream" is opposite the direction of "downstream" going opposite the direction of flue gas flow.

Generally, in the operation of the power generation system 10 and more specifically, the combustion system 11, the combustion of fuel in the boiler 12 heats water in the waterwalls 23 of the boiler 12, which then passes through the steam drum (or equivalent), hereinafter referred to as drum 25. Heated steam is then directed to the superheater 27 in the superheater zone 26, where additional heat is imparted to the steam by the flue gases. The superheated steam from the superheater 27 is then directed via a piping system shown generally as 60 to a high-pressure section 52 of turbine 50, where the steam is expanded and cooled to drive turbine 50 and thereby turn a generator 58 to generate electricity. The expanded steam from the high-pressure section 52 of the turbine 50 may then be returned to a reheater 29 to reheat the steam, which is subsequently directed to an intermediate pressure section 54 of turbine 50, and ultimately a low-pressure section 56 of the turbine 50 where the steam is successively expanded and cooled to drive turbine 50.

As illustrated in FIG. 1, the combustion system 11 includes an array of sensors, actuators, and monitoring devices to monitor and control the ignition and combustion process and the resulting consequences concerning boiler operation. For example, temperature and pressure monitors shown generally and collectively as 36, 37 are employed throughout the system and are interfaced with a control unit 200 to ensure proper control, operation and ensure that operational limits of the combustion system 11 and boiler 12 are not exceeded. In another example, the combustion system 11 may include a plurality of fluid flow control devices 30, also interfaced with the control unit 200, that supply secondary air for combustion to each fuel introduction nozzle associated with the burner assemblies 14. In an embodiment, the fluid flow control devices 30 may be electrically actuated air dampers that can be adjusted to vary the amount of air that is provided to each fuel introduction nozzle associated with each burner assembly 14.

The boiler 12 may also include other individually controllable air dampers or fluid flow control devices 30 at various spatial locations around the furnace and boiler 12. Each of the flow control devices 30 is independently controllable by a control unit 200 to ensure that desired air/fuel ratios and flame temperature are achieved for each nozzle location. Furthermore, the power generation system 10 may also include a plurality of fluid flow control devices 66, that in an example, control the flow of water or steam in the system 10. In an embodiment, the fluid flow control devices 66 may be electrically actuated valves that can be adjusted to vary the amount of flow therethrough. Each of the fluid flow control devices, e.g., 66, is individually controllable by a control unit 200.

FIG. 1 also illustrates a backpass (or backdraft section) 33 of the boiler 12 downstream from the superheater 27, reheater 29, and economizer 31 in economizer zone 28. The backpass 33 may also be fitted with a monitoring device 37. The monitoring device 37, such as a gas sensor 37 may optionally be configured for measurement and assessment of gas species such as carbon monoxide (CO), carbon dioxide ($CO_2$), mercury (Hg), sulfur dioxide ($SO_2$), sulfur trioxide ($SO_3$), nitrogen dioxide ($NO_2$), nitric oxide (NO), oxygen ($O_2$), and the like within the backpass 33. $SO_2$ and $SO_3$ are collectively referred to as SOx. Similarly, $NO_2$ and NO are collectively referred to as NOx.

Continuing with the operation of the boiler 12, optionally, a predetermined ratio of fuel and air is provided to each of the burner assemblies 14 for combustion. As the fuel/air mixture is combusted within the furnace and flue gases are generated, the combustion process and flue gases produced are monitored. In particular, various parameters of the fireball and flame, conditions on the walls of the furnace, and various parameters of the flue gas may be sensed and monitored. These parameters may be communicated to the combustion control unit 200, where they are analyzed and processed according to a control algorithm stored in memory and executed by a processor. The control unit 200 is configured to control the fuel provided to the boiler 12 and/or the air supplied to the boiler 12, in dependence upon the one or more monitored combustion and flue gas parameters and furnace wall conditions.

Figure 2:
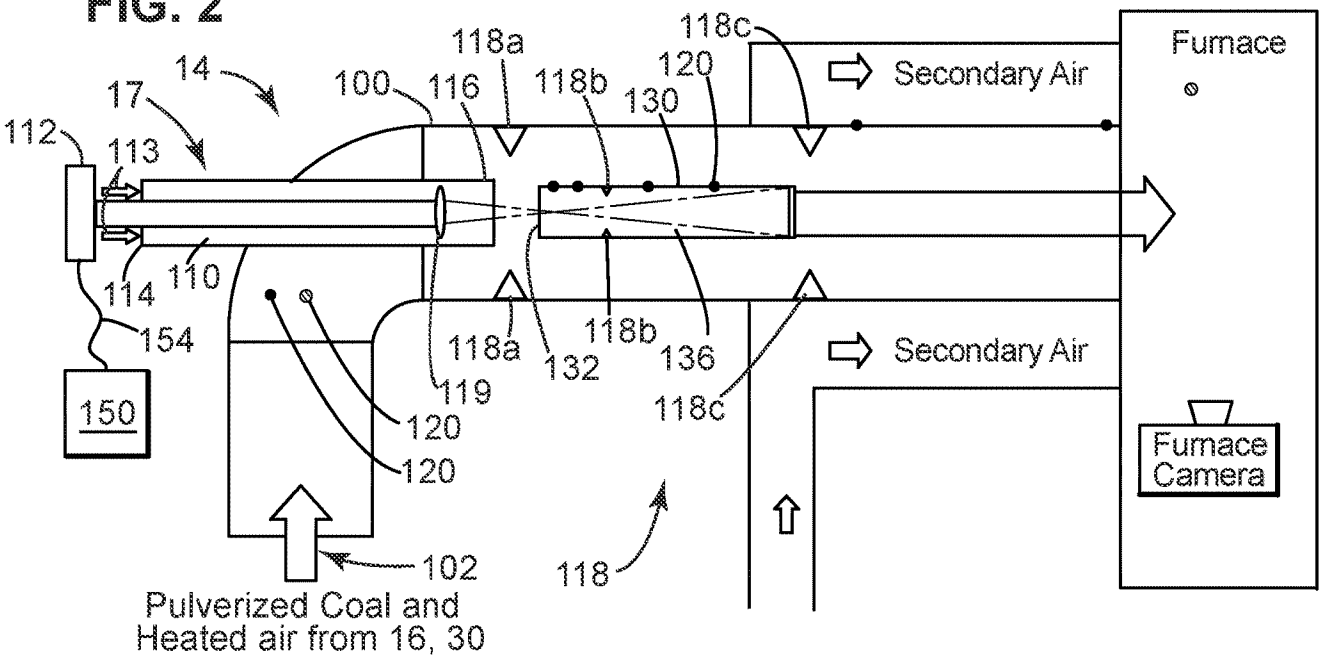
FIG. 2 is an illustration of a section of an example ignition tube and ignitor in accordance with an embodiment.

FIG. 2 depicts a simplified block diagram of a primary burner assembly 14 and the laser ignition system 17 as part of the combustion system 11 in accordance with an embodiment. In an embodiment, the burner assembly 14 includes, but is not limited to, a tube 100 carrying pulverized coal particles, shown generally as 102 from the pulverizer 16 and primary air from the air source 18, similar to that of existing burner assemblies. In the figures the tube 100 is depicted as a circular cross-section; however, such depiction is merely for illustration purposes. The tube 100 can be of any variety of configurations and or cross-sections including, but not limited to, circular, square, rectangular, triangular, or polygonal without limiting the scope of the embodiments as described herein.

The tube 100 of the primary burner assembly 14 is also equipped with one or more flow directing devices, shown generally as 118 and individually as 118*a*, 118*b*, 118*c* and the like. The flow directing device(s) 118 is operable to aid in directing the flow of pulverized coal particles 102 and air in the tube 100. The flow directing device(s) may be distributed around the circumference of the tube 100 or the ignition tube 130 or both. In an embodiment, the flow directing devices 118 operate to direct and focus the coal particles 102 in the burner assembly 14. The function of the flow directing device(s) 118 is to divert a controllable fraction of this fuel by mechanical means to a selected location in the tube 100 for ignition by an igniter, e.g., the laser igniter 17 of the described embodiments. The magnitude of fuel flow injected into the burner is determined by the desired operating point of the burner. The flow directing device 118 is designed to ensure that the coal particles 102 spend the maximum of time inside the spatial envelope of the focused or collimated laser beam, as described in more detail herein. In an embodiment, the flow directing devices 118 may be controllable venturi ports. In another embodiment, the flow directing devices 118 may be static or controllable baffles or vanes. In an embodiment, the flow directing devices 118 may be implemented as static or controllable structures having a variable shape that causes the redirection of flow in the tube. For example, the flow directing devices may have a straight or curved leading edge to impart variable adjustments or corrections to the flow of air and coal particles in the tube 100 or ignition tube 130. In an embodiment, the flow directing devices 118 operate to direct the flow of coal particles 102 to primarily the center of the tube 100 for direct impingement of the laser light from the laser igniter 17 as described further herein. In another embodiment, the function of the flow directing device 118*a* is to divert a controllable fraction of the fuel and airflow in the tube 100 by mechanical means into an optional ignition tube 130, as will be described in further detail herein.

In an embodiment, the tube 100 is configured with the laser igniter 17 enclosed therein. In one embodiment, the tube 100 is configured with the laser igniter 17 substantially, but not necessarily concentric therein. The laser igniter 17 includes a second tube 110, denoted as the laser tube 110 encompassing the laser light directed through the laser tube 110 and the optional ignition tube 130. The laser tube 110 has a laser input 112 and air input 113 at a first end 114, and a focusing lens 119 at a second or exit end 116. The air input 113 directs air along the length of the laser tube 110, provides cooling, and maintains the laser tube 110 at a positive pressure and flow to ensure the laser tube 110 remains clean and avoids the entry of any coal particles 102 from the tube 100.

The laser input 112 may include, but not be limited to, an input from a laser source 150 operably connected to a controllable electrical supply. The laser source 150 may include a laser diode (not shown), fiber laser, or any high-power CW or pulsed laser, from which light is directed through selected lenses, gratings, couplers, and the like for coupling to an optical fiber 154. The laser light is optically coupled to the laser input 112 via the optical fiber 154. Advantageously, by employing one or more optical fiber(s) 154 to couple the energy from the laser source to the laser igniter 17, permits the laser diode light source 150 and associated optics to be located some distance from the laser igniter 17 and the challenging environment of the combustion system 11. In an embodiment, laser light may be carried with multiple fibers 154 from smaller power lasers such that the total power of the laser system is high. For example, a multiple of smaller power lasers can be collectively utilized to generate laser light or a laser beam having a larger beam volume at a high intensity. In this manner, the cumulative energy heats up the flowing coal particles 102 and not necessarily a "single focal spot" of the laser as in the case of laser machining. Advantageously, such a modular construction lowers the cost of the laser igniter and makes the system flexible and scalable. The total power of the system may readily be adjusted or increased by adding more fiber(s) and/or laser(s). Furthermore, this scheme facilitates system robustness, eliminating any single point of failure within the laser source 150 whole ignition system of the combustion system 11. Though it is convenient as described herein to utilize continuous wave (CW) fiber-coupled laser so that it may permit placement of the laser source 150 some distance away from the combustion system 11, such description is merely for illustration. Other embodiments and configurations are possible. For example, it could be possible to employ a high-power free-space coupled optical energy beam through a series of mirrors and/or lenses.

At the laser input, the photons emanating from the optical fiber 154 are collimated and transported to an ignition zone via the laser tube 110, which advantageously is cooled and purged as described herein. Within the laser tube 110, the photons are focused to a tight spot size at a selected location near the entrance of the ignition tube 130 with a lens 119 that is located some distance away inside the laser tube 110. In another embodiment, the photons are simply left collimated and directed from the laser tube 110 to the ignition tube 130. The focused or collimated photons from the laser received via the laser input 112 are directed to the ignition tube 130. As a result, the laser tube 100 remains simpler and of smaller dimension and is less intrusive to the coal flow than with conventional plasma igniters. Purging in the laser tube 110 and the simplified configuration minimizes fouling of the laser tube 110 and increases maintenance intervals of the laser igniter 17, particularly as compared to conventional plasma igniters. In some embodiments, it may also be advantageous to focus the laser deeper in the ignition tube 130. For instance, it may be desirable to focus the laser beam into the burner and not necessarily near the exit end 116 of the laser tube 110. This could become desirable to achieve certain volume heating of the coal particles 102 by laser energy in a given burner geometry.

Continuing with FIG. 2, in an embodiment, the laser igniter 17 also includes an optional ignition tube 130. The ignition tube 130 has open ends with one end 132 closer to the laser tube 110. The ignition tube 130 is substantially concentric with and within the tube 100 and on substantially the same axis as the laser tube 110, though it need not be. In an embodiment, the ignition tube 130 is located axially, downstream of the laser tube 110 in the flow of air and coal particles 102. The coal particles 102 and airflow in the tube 100 are directed by flow directing devices 118 disposed on the tube 100 to enter the ignition tube 130. In an embodiment, additional flow control devices, shown in this instance as **118*b*, may also be disposed on an inner wall 136 within the ignition tube 130. These flow directing device(s)s 118*b* may be utilized to further direct the flow of coal particles 102 and air as they flow through the ignition tube 130 concentrating the coal particles 102 at about a selected location within the ignition tube 130. In an embodiment, the coal particles 102 are directed substantially to the center of the ignition tube 130 to ensure the particles 102 are targeted with, and absorb, as many photons from the laser as possible. In an embodiment, the collimated or focused photons are directed substantially to the center of the ignition tube 130 for concentration at a focal point of the photons. In an embodiment, it is desirable to achieve distribution of photons of the laser beam and coal particles 102 such that a controlled or selected amount of the coal particles 102 achieve critical ignition. The direction and ignition are controlled to ensure that the igniter 17 avoids the situations where too few coal particles 102 absorb much more laser energy than needed or, conversely, a condition where too many coal particles 102 absorb the laser energy, dividing it to such extent that too few coal particles 102 are ignited to achieve overall ignition and flame propagation. In an embodiment, this control is achieved by balancing the interplay between laser beam geometry as well as coal particle 102** distribution flowing in the laser beam.

Figure 3:
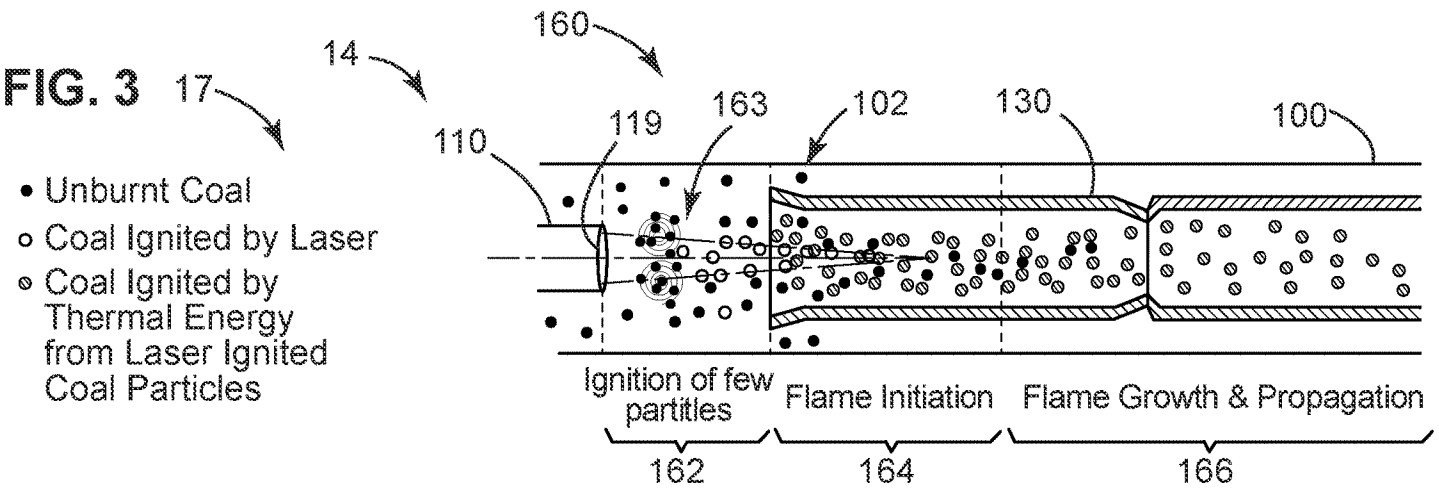
FIG. 3 is a more detailed illustration of the ignitor system and ignition tube of FIG. 2 in accordance with an embodiment.

In an embodiment, it should be appreciated that the tube 100 and in embodiments employing it, whether including the optional ignition tube 130 or not, may be divided into multiple stages 160 of operation/ignition. It should also be appreciated that while several embodiments have been described as utilizing the optional ignition tube 130, such description is for illustration. The described functionality and operation of the combustion system 11 and more specifically, laser ignitor 17, may be implemented with or without the optional ignition tube 130. FIG. 3 provides a diagrammatic depiction of the multistage ignition process as described in the embodiments herein and depicts the various stages of ignition and combustion, shown generally as 160. In one embodiment, only the first stage of ignition, depicted as 162, primarily requires laser photon absorption for the ignition of a small number of coal particles 102 via the direct absorption of photon energy. Downstream in the tube 100, or ignition tube 130, as depicted in the figure, in a second stage 164, the combusting coal particles 102 generate flame, which seeds heating and ignition of more coal particles 102 that were not ignited in the first stage 162, e.g., not yet ignited and directly enters the second ignition stage 164. As a result, the subsequent ignition in the second stage 164 results in further expansion and propagation of the ignition and flame in and from the ignition tube 130 into the burner assembly 14 as all coal particles are ignited as depicted at 166.

Advantageously the described embodiments overcome the need for an intermediary heat-transfer-medium (like a plasma or a flame) to transfer energy to the coal particle. In the described embodiments, energy is directed to the coal particles 102 directly by the laser photons themselves. As the photons impinge on the coal particles 102, they absorb the energy in the photons, heat up, and ignite. In some embodiments, to accelerate the ignition process, a preheating process may be employed. In one embodiment, the ignition tube 130 is preheated by allowing the laser photons to impinge on the inner wall 136 of the ignition tube 130 (in the absence of coal particles 102 and airflow) heating the ignition tube. In another embodiment, the ignition tube 130 is preheated by igniting the coal particles within the ignition tube 130, which in turn heats the ignition tube 130. This preheating makes ignition tube 130 hotter, preheats the coal particles 102 and air mixture, and thereby reduces the laser power required for igniting the coal particles 102 directly by photon-absorption. In another embodiment, to facilitate ignition, the primary air may also be preheated so that the temperature of the coal particles 102 are raised, making laser ignition easier and with less laser power needed to raise the temperature of the coal particles 102 beyond the ignition point. As a result, advantageously, it is expected that a laser igniter 17, as described herein, is expected to require less laser power to ignite the coal burner 14 than in the case of existing plasma igniters.

In yet another embodiment the laser ignition of the coal particles 102 may be further enhanced or facilitated by further airflow and directional control. In an embodiment, the air velocity coming out of the laser tube 110 can be slower than the velocity of air flowing through the surrounding burner and tube 100. Under such conditions, a recirculation zone shown generally as 163 (e.g., an eddy in the flow) in the ignition stage 162 will be created in front of the laser tube 110 in the laser beam path. Coal particles 102 trapped in this recirculation zone 163 will pass/traverse the laser beam multiple times increasing their time spent in the laser beam and absorbing photons for heating. As a result, this recirculation will increase the probability of the coal particles 102 igniting and subsequently, these particles 102 further facilitating the ignition of the rest of the coal particles 102 in the burner. In one embodiment, the flow of the mixture of the coal particles 102 and air flow through the tube 100 can be slowed or lowered to a predetermined minimal allowed velocity in order to maximize the time that the mixture of coal and air are within the laser beam emitted from the laser tube 110. In this manner, the mixture of coal and air can be irradiated longer in the recirculation zone and in the various stages of the ignition tube 130. In another embodiment, the flow control devices 118 and the air flow velocity in the laser tube 110 and/or the tube 100 may be employed to control the recirculation zone 163, and thereby the residence time of the coal particles 102 in the path of the laser light for initial ignition and then later, to stabilize the flame.

In another embodiment, to facilitate laser ignitions, the coal particle 102 and/or airflow velocities may be controlled, in this instance, reduced. Reducing the velocities results in slowing down the coal particles 102 making them flow in the laser beam absorbing photons for a longer duration. Such an increase in residence time enables the coal particles to absorb more energy from the laser beam. Such an approach also may enable the utilization of lower power output, or even lower rating for the laser to ignite the coal particles 102, thus reducing the cost.

Another potential advantage of laser igniter 17 of the described embodiments over the plasma igniters is that energy input is directed only to coal particles 102, which absorb the laser radiation and not air, which does not absorb the radiation. Thus, the initial ignition of coal particles 102 is achieved more efficiently as compared to other igniters like oil, gas, or plasma igniters, which end up heating the surrounding air medium also. Another advantage of the laser igniter 17 of the described embodiments is that, in oil, gas, or plasma igniters, the transfer heat energy to coal particles 102 is typically violent and turbulent. As a result, the turbulence disturbs the coal particle 102 flow making it difficult to simulate and design the initial ignition of coal particles 102. Laser photons are absorbed by the coal particles 102 without disturbing the coal particle 102 and airflow, thus making it easier to simulate, design, and control the ignition of coal particles 102 in the coal-based combustion systems 11. As a result, improved ignition properties for the igniter 17 can be designed and achieved.

Figure 4:
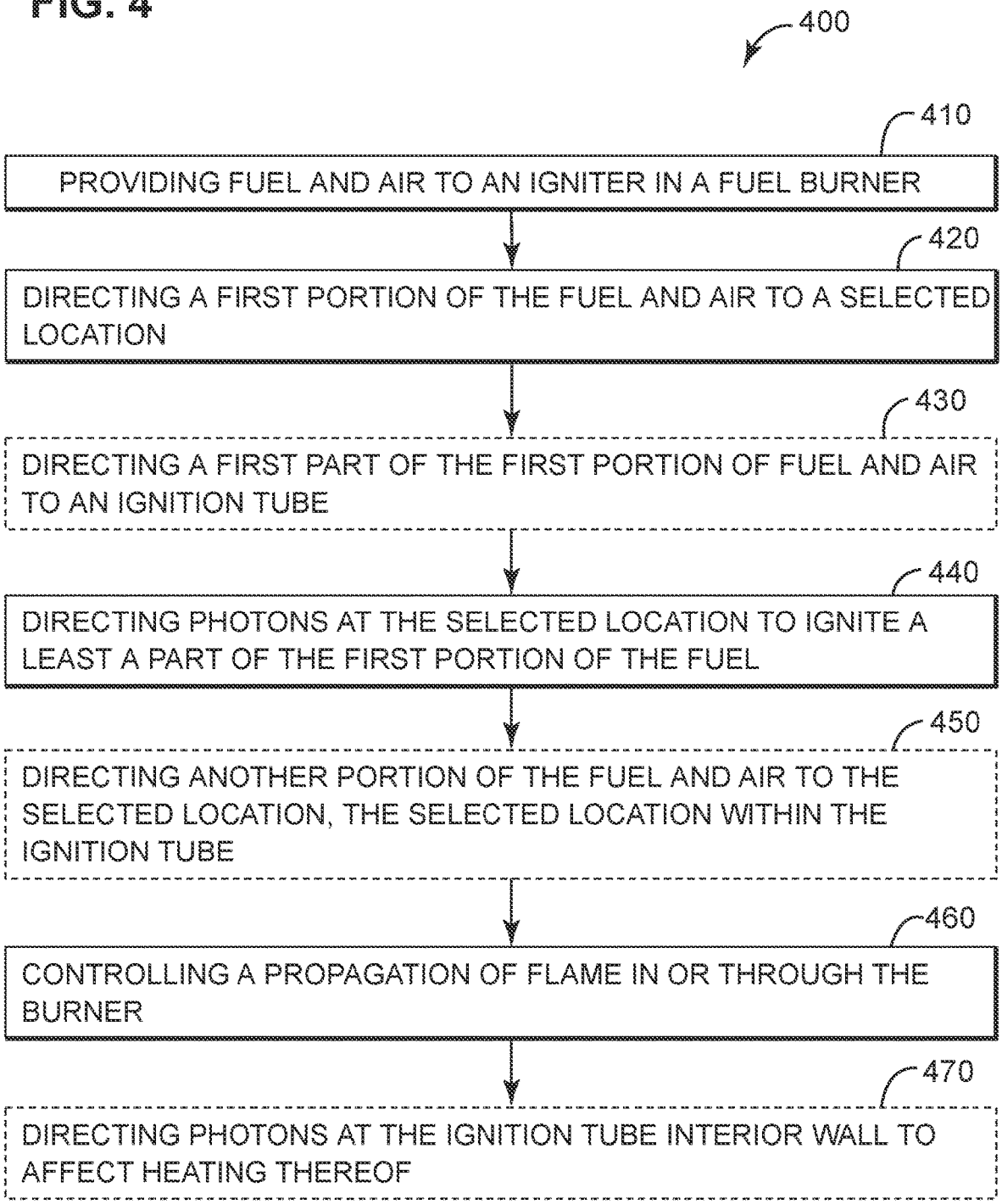
FIG. 4 is a flow chart illustration of an ignition methodology in accordance with an embodiment.

Turning now to FIG. 4, in the described embodiments, the method 400 monitors the ignition in the combustion system 11 of the in a boiler system 12. The method 400 initiates as depicted at process step 410 with providing fuel and air to the igniter 17 of a burner 14. As described herein, the fuel may be pulverized coal in the form of coal particles 102 and air. In an embodiment, the coal particles 102 are sorted to be of a selected size desirable for ignition, as described herein. The method 400 continues with directing a first portion of the fuel and air mixture to a selected location within the tube 100, as depicted at process step 420. As depicted at process step 430, optionally, directing a first part of the first portion of the fuel and air mixture to the ignition tube 130. The method 400 continues with process step 440 and directing photons from a laser tube 110 to the selected location to ignite a least a part of the first portion of the fuel. In an optional embodiment, the selected location is within the ignition tube 130. The selected location corresponds to a focal point for the photons as they are being directed from the laser tube 110. At process step 450, optionally, directing another portion of the first part of the first portion of the fuel and air mixture within the ignition tube 130 to facilitate the combustion of the fuel therein. The method 400 continues at process step 460 where the propagation of the flame in or through the burner 14 is controlled. Finally, as depicted at optional process step 470, the method 400 may also include directing photons at the inner wall 136 of the ignition tube to facilitate heating of the ignition tube 130 and thereby ignition and combustion of the coal particles 102 therein.

It should be appreciated that while various steps of the method 400 are depicted in a particular order, they need not be, and are described in such order merely to illustrate the examples of the embodiments. Some steps may readily be conducted in a different order. In addition to operational savings, the laser ignition system 17 of the described embodiments provide for capital cost savings, space savings, and energy savings compared to existing plasma igniters as well as simplified design and construction. In particular, with the control system disclosed herein, it is possible to implement closed-loop control of the laser igniter to precisely control fuel ignition and combustion for optimum performance of the burner. For example, in an embodiment, the ignition of the coal particles 102 may be controlled with mechanically movable electrically controlled flow directing devices 118 to control the flow to achieve ignition with one selected configuration and yet sustain it with another. Such a configuration for the laser igniter 17 once again improves operability and efficiency over existing as the laser igniter 17 as laser energy does not disturb the flow of coal particles 102.

In an embodiment, pressure and or temperatures sensors 120 (FIG. 2) may be, but are not necessarily, utilized to monitor the ignition in the laser igniter 17. While not necessary, utilization of such sensors 120, expands the capability of the laser igniter 17 and overall combustion system 11 and may be employed throughout the system 14 and in particular in the tube 100 and ignition tube 130. For example, pressure sensors 120 in the burner tube 100 may provide an indication when there is a sudden expansion of gases due to ignition. Such pressure changes could serve as an indication of initial ignition to facilitate ignition control in the igniter. Similarly, the thermocouples on the ignition stages, e.g., 162, 164 ensure that sustained combustion is being achieved due to the laser igniter 17. Measured temperatures can be used to achieve controlled ignition and sustained combustion. For example, in an embodiment, the laser power could be maintained at high levels for a short duration to achieve the initial ignition of the coal particles 102, and then gradually be reduced to achieve and sustain ignition. As a result, the average power required for the laser source 150 would be reduced, thus reducing the cost of the laser source 150.

The control unit 200 may include the necessary electronics, software, memory, storage, databases, firmware, logic/state machines, microprocessors, communication links, displays or other visual or audio user interfaces, printing devices, and any other input/output interfaces to perform the functions described herein and to achieve the results described herein. For example, as previously mentioned, in an embodiment, the control unit 200 may be implemented as self-contained or modular components of the power generation system 10 include at least one processor or processing module (not shown) and system memory/data storage structures, which may include random access memory (RAM) and read-only memory (ROM). The processor of the module may include one or more conventional microprocessors, microcontrollers, and one or more supplementary co-processors such as math co-processors or the like. The data storage structures discussed herein may include an appropriate combination of magnetic, optical, and/or semiconductor memory, and may include, for example, RAM, ROM, flash drive, an optical disc such as a compact disc and/or a hard disk or drive. The control unit 200 may be implemented in the form of an integrated microcontroller where each of the functions may be integrated into a single package, ASIC, or FPGA as needed to interface with various sensors, control valves, modules, and the like to implement the functionality, processing, and communications described herein.

Additionally, a software application that adapts the combustion system 11 and laser igniter 17 to perform the method 400 disclosed herein may be read into a main memory of the at least one processor from a computer-readable medium. Thus, the described embodiments may perform the methods disclosed herein in real-time. While in embodiments, the execution of sequences of instructions in the software application causes at least one processor to perform the methods/processes described herein, hard-wired circuitry may be used in place of, or in combination with, software instructions for implementation of the described methods/processes. Therefore, embodiments, as described herein, are not limited to any specific combination of hardware and/or software.

The term "computer-readable medium," as used herein, refers to any medium that provides or participates in providing instructions to the at least one processor of the control unit 200 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random-access memory (DRAM), which typically constitutes the main memory. Common forms of computer-readable media include, for example, a floppy disk, a flexible disk, hard disk, solid-state drive (SSD), magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

In one embodiment, each of the sensors, e.g., 36, may be hard-wired to the control unit 200. In another embodiment, a low powered communications interface may be employed. The communications interface interfaces with an interconnect/network, which interconnects components of the system 10 and one or more controllers such as control unit 200. The network may be a mix of wired and wireless components and can leverage the communications networks, including an IP network. It should be understood that the interconnect/network may include wired components or wireless components, or a combination thereof. Such wired components may include regular network cables, optical fibers, electrical wires, or any other type of physical structure over which the sensors 36, control valves 30, 66, control unit 200, and other devices of the boiler system 10 can communicate. The network may include wireless components and may include radio links, optical links, magnetic links, sonic links, or any other type of wireless link over which the sensors, control valves 30, 66, and control unit 200 can communicate. In an embodiment, a wireless communications interface and a wireless network may be employed. For example, the communications interface may use various techniques, technologies, and protocols to facilitate the implementation of the described embodiments and are in no way limiting. For example, the communications interfaces and the network could be implemented as Ethernet, WiFi®, Bluetooth®, NFC, and the like. The network may be implemented employing a hub and spoke type construct or as a mesh network construct. In some embodiments, a wireless mesh network may be utilized to permit a plurality of sensors, control valves 30, 66 deployed around a boiler 12 to communicate with each other, coordinate measurements, and pass data back to a control unit 200.

It should be appreciated that while the boiler 12, and more specifically, laser ignition system 17 or control unit 200 may be described as implemented including various separated modules for the various components, such description is merely for illustration and example. In one or more embodiments, the functionality of all or some of the described components may readily be integrated or combined as needed. For instance, in an embodiment, the functionality of the sensors 36, control valves 30, 66, processing module 400, and communications interface/network and the like may be integrated into whole or part into a microcontroller, ASIC, FPGA, and the like.

In an embodiment, described herein is a method of igniting fuel in a combustion burner. The method includes providing a flowing fuel and air mixture to an igniter in a fuel burner, directing a first portion of the flowing fuel and air mixture to a location in the burner, and directing photons from a laser at the location to ignite at least a part of the first portion of the fuel.

In addition to one or more of the features described above, or as an alternative, further embodiments of the method may include controlling a propagation of a flame in or through the burner based at least in part on directing a flow of at least one of the first portion, the first part of the first portion, and a second portion of the fuel and air mixture.

In addition to one or more of the features described above, or as an alternative, further embodiments of the method may include that the controlling is based at least in part on directing the second portion of the flowing fuel and air mixture to mix with the ignited at least a part of the first portion.

In addition to one or more of the features described above, or as an alternative, further embodiments of the method may include directing the first portion of the fuel and air mixture to the selected location within an ignition tube.

In addition to one or more of the features described above, or as an alternative, further embodiments of the method may include including directing a part of the first portion of the fuel and air mixture to a selected location within the ignition tube.

In addition to one or more of the features described above, or as an alternative, further embodiments of the method may include preheating the ignition tube by directing photons from a laser at an interior wall of the ignition tube prior to the direction of the first portion of the fuel and air mixture.

In addition to one or more of the features described above, or as an alternative, further embodiments of the method may include directing photons from a laser at the location in the ignition tube to ignite at least some of the fuel in the part of the first portion of the fuel.

In addition to one or more of the features described above, or as an alternative, further embodiments of the method may include cooling the ignition tube by directing another portion of the fuel and air mixture along an outer wall of the ignition tube.

In addition to one or more of the features described above, or as an alternative, further embodiments of the method may include that the directing is based on a flow control device configured to modify a direction of the flowing fuel and air in the tube.

In addition to one or more of the features described above, or as an alternative, further embodiments of the method may include enhancing an intensity of photons directed to the location by at least one of collimating the photons with a collimator focusing the photons with a lens.

Also described herein in another embodiment is a system igniting a coal air-fuel mixture. The system including a burner having a burner tube operable to carry a flowing mixture of fuel and air to a furnace for combustion therein, a first flow directing device disposed within the tube, the first flow directing device operable to direct a first portion of the flowing fuel and air mixture to a location in the burner tube, and a laser igniter within the burner tube. The laser igniter includes a laser tube, the laser tube having a first end with a laser light input and a second end with a light output, a laser light source operably coupled to the laser light input. Where the laser light source includes a laser, and the laser ignitor directs photons from the light output at the location in the burner tube to ignite at least a part of the first portion of the fuel.

In addition to one or more of the features described above, or as an alternative, further embodiments of the system may include a second flow directing device disposed within the tube, the second flow directing device operable to direct a second portion of the flowing fuel and air mixture in the tube to control propagation of a flame in or through the burner.

In addition to one or more of the features described above, or as an alternative, further embodiments of the system may include that the controlling of the propagation is based at least in part on directing the second portion of the flowing fuel and air mixture to mix with the ignited at least a part of the first portion.

In addition to one or more of the features described above, or as an alternative, further embodiments of the system may include an ignition tube within the tube, the ignition tube substantially concentric with and axially downstream of the laser tube in the flowing mixture of fuel and air.

In addition to one or more of the features described above, or as an alternative, further embodiments of the system may include that the first flow directing device directs first portion of the fuel and air mixture to a selected location within the ignition tube.

In addition to one or more of the features described above, or as an alternative, further embodiments of the system may include a second flow directing device disposed within the ignition tube, the second flow directing device operable to direct at least a part of the first portion of the flowing fuel and air mixture to a location, and the laser ignitor directing photons from the light output at the location in the ignition tube to ignite the at least a part of the first portion of the fuel.

In addition to one or more of the features described above, or as an alternative, further embodiments of the system may include a third flow directing device disposed within the tube, the third flow directing device operable to direct at least another portion of the flowing fuel and air mixture in the tube.

In addition to one or more of the features described above, or as an alternative, further embodiments of the system may include that the third flow directing device operable to control a propagation of a flame in or through the burner based at least in part on directing a flow of at least one of the first portion, the first part of the first portion, and a second portion of the fuel and air mixture.

In addition to one or more of the features described above, or as an alternative, further embodiments of the system may include at least one of a collimator for collimating the photons within the laser tube and a lens for focusing the photons at the location.

In addition to one or more of the features described above, or as an alternative, further embodiments of the system may include that the laser light source is remote from the laser light input.

In addition to one or more of the features described above, or as an alternative, further embodiments of the system may include that the laser beam formed by a combination of multiple laser beams.

In addition to one or more of the features described above, or as an alternative, further embodiments of the system may include varying the intensity of the laser under selected conditions, such as spiking the laser intensity to a first level during initial ignition and lowering laser intensity thereafter to achieve stable ignition.

In addition to one or more of the features described above, or as an alternative, further embodiments of the system may include different venturi designs configurable to vary the flow of coal particles and air in at least one of the tube and the ignition tube.

In addition to one or more of the features described above, or as an alternative, further embodiments of the system may include slowing down the coal flow for initial ignition.

In addition to one or more of the features described above, or as an alternative, further embodiments of the system may pre-heating at least one of the ignition tube, the tube, the coal particles, and the air directed to the ignition tube.

In addition to one or more of the features described above, or as an alternative, further embodiments of the system may include controlling the flow direction and laser power for initial ignition and then reverting to different configuration and laser power for a stable flame.

As used herein, "electrical communication" or "electrically coupled" means that individual components are configured to communicate with one another through direct or indirect signaling by way of direct or indirect electrical connections. As used herein, "mechanically coupled" refers to any coupling method capable of supporting the necessary forces for transmitting torque between components. As used herein, "operatively coupled" refers to a connection, which may be direct or indirect. The connection is not necessarily being a mechanical attachment.

As used herein, an element or step recited in the singular and proceeded with the word "a" or "an" should be understood as not excluding plural of said elements or steps, unless such exclusion is explicitly stated. Furthermore, references to "one embodiment" of the described embodiments are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Additionally, while the dimensions and types of materials described herein are intended to define the parameters associated with the described embodiments, they are by no means limiting and are exemplary embodiments. Many other embodiments will be apparent to those of skill in the art upon reviewing the above description. The scope of the invention should, therefore, be determined with reference to the appended claims. Such description may include other examples that occur to one of ordinary skill in the art, and such other examples are intended to be within the scope of the claims if they have structural elements that do not differ from the literal language of the claims, or if they include equivalent structural elements with insubstantial differences from the literal languages of the claim. In the appended claims, the terms "including" and "in which" are used as the plain English equivalents of the respective terms "comprising" and "wherein." Moreover, in the following claims, terms such as "first," "second," "third," "upper," "lower," "bottom," "top," etc. are used merely as labels and are not intended to impose numerical or positional requirements on their objects. Further, the limitations of the following claims are not written in means-plus-function format are not intended to be interpreted as such, unless and until such claim limitations expressly use the phrase "means for" followed by a statement of function void of further structure.

What is claimed is:

1. A combustion burner assembly, comprising:

a fuel source;

an air source;

a furnace;

a fuel transport tube to transport a mixture of fuel from the fuel source and air from the air source to the furnace;

a laser igniter configured to ignite the mixture of fuel and air carried through the fuel transport tube to the furnace, the laser igniter including:

a laser source;

a laser tube to deliver a beam of laser light from the laser source to the mixture of fuel and air in the fuel transport tube; and an ignition tube disposed within the fuel transport tube to receive a portion of the mixture of fuel and air flowing through the fuel transport tube, wherein the beam of laser light heats and ignites the mixture of fuel and air in the ignition tube, wherein the ignition of the mixture of fuel and air in the ignition tube occurs in a multiple of ignition stages; and a flow control device configured to reduce a velocity of air coming out of the laser tube to a velocity that is slower than a velocity of the flow of the mixture of fuel and air in the fuel transport tube, creating a recirculation zone in a region between an outlet of the laser tube and an inlet to the ignition tube, wherein the mixture of fuel and air carried in the fuel transport tube recirculates for more exposure in the recirculation zone to the beam of laser light prior to entering the ignition tube.

2. The combustion burner assembly of claim 1, the flow control device further comprising a plurality of flow directing devices located about the fuel transport tube and the ignition tube, wherein a first set of flow directing devices is located on an inner wall of the fuel transport tube and a second set of flow directing devices is located on an inner wall of the ignition tube, the first set of flow directing devices including at least one flow directing device downstream of the outlet of the laser tube and upstream of the inlet of the ignition tube and at least one flow directing device at a location on the inner wall of the fuel transport tube that is oriented transversely to a periphery of an outlet of the ignition tube, the second set of flow directing devices including at least one flow directing device downstream of the inlet of the ignition tube, wherein the plurality of flow directing devices are configured to direct a portion of the flow of the mixture of fuel and air to flow about the ignition tube for irradiation by the beam of laser light.

3. The combustion burner assembly of claim 2, wherein the at least one flow directing device downstream of the outlet of the laser tube and upstream of the inlet of the ignition tube is configured to direct the flow of the mixture of fuel and air in the fuel transport tube towards the inlet of the ignition tube, and wherein the at least one flow directing device at the location on the inner wall of the fuel transport tube that is oriented transversely to the periphery of the outlet of the ignition tube is configured to direct any portion of the flow of the mixture of fuel and air that avoids entering the inlet of the ignition tube towards the ignited flow of fuel leaving the outlet of the ignition tube for mixture therewith and subsequent ignition.

4. The combustion burner assembly of claim 2, wherein the plurality of flow directing devices comprise venturi-shaped devices.

5. The combustion burner assembly of claim 1, wherein a portion of the laser tube is disposed within the fuel transport tube, wherein the portion of the laser tube disposed in the fuel transport tube is separated from the ignition tube by a predetermined spacing, wherein the predetermined spacing between the portion of the laser tube disposed in the fuel transport tube and the ignition tube forms the recirculation zone where particles of the fuel carried in the fuel transport tube recirculate for more exposure to the beam of laser light prior to entering the ignition tube, wherein the particles of the fuel in the recirculation zone absorb photons of the beam of laser light, and heat up to cause an initial ignition of some of the particles, the initial ignition causing subsequent absorbing, heating, and ignition of other particles of fuel in the recirculation zone.

6. The combustion burner assembly of claim 5, wherein the multiple of ignition stages of the ignition tube comprises a flame initiation stage and a flame growth and propagation stage, wherein the flame initiation stage receives the fuel particles from the recirculation zone for further irradiation by the beam of laser light, the further irradiation leading to combustion and flame generation, and wherein the flame growth and propagation stage receives the fuel particles undergoing combustion and flame generation in the flame initiation stage for additional irradiation by the beam of laser light, the additional irradiation leading to further flame growth and propagation of the flame out from the ignition tube towards the furnace.

7. The combustion burner assembly of claim 1, wherein the second set of flow directing devices comprises a plurality of ignition flow directing devices, wherein each of the ignition flow directing devices is configured to direct the flow of the mixture of fuel and air to concentrated locations within the ignition tube for irradiation by the beam of laser light received from the laser tube.

8. The combustion burner assembly of claim 1, further comprising an optical device to direct the beam of laser light towards the ignition tube.

9. The combustion burner assembly of claim 1, wherein the laser source comprises a plurality of smaller powered lasers each configured to generate a small beam volume of laser light, wherein the laser tube is configured to direct a collection of the small beam volumes of laser light from each of the plurality of smaller powered lasers to the mixture of fuel and air flowing through the fuel transport tube, the collection of the small beam volumes of laser light forming a larger beam volume of laser light at a high intensity that heats up the mixture of fuel and air flowing through the fuel transport tube.

10. A system, comprising:

a coal fuel source;

an air source;

a furnace;

a fuel transport tube to transport a mixture of coal from the coal fuel source and air from the air source to the furnace for combustion thereof;

a laser igniter configured to ignite the mixture of coal and air carried through the fuel transport tube to the furnace, the laser igniter including:

a laser source;

a laser tube to deliver a beam of laser light from the laser source to the mixture of coal and air in the fuel transport tube, wherein a portion of the laser tube is disposed within the fuel transport tube; and an ignition tube disposed within the fuel transport tube to receive a portion of the mixture of coal and air flowing through the fuel transport tube, wherein an inlet of the ignition tube is separated from the portion of the laser tube disposed in the fuel transport tube by a predetermined spacing, wherein the beam of laser light heats and ignites the mixture of coal and air in the predetermined spacing and in the ignition tube in a multiple of ignition stages;

a plurality of flow directing devices, wherein each of the flow directing devices is configured to direct a portion of the flow of the mixture of coal and air to flow about the ignition tube for irradiation by the beam of laser light; and the flow control directing devices are configured to reduce a velocity of air coming out of the laser tube to a velocity that is slower than a velocity of the flow of the mixture of coal and air in the fuel transport tube, creating a recirculation zone in a region between an outlet of the laser tube and an inlet to the ignition tube, wherein the mixture of coal and air carried in the fuel transport tube recirculates for more exposure in the recirculation zone to the beam of laser light prior to entering the ignition tube.

11. The system of claim 10, wherein the plurality of flow directing devices comprises a pair of opposing flow directing devices disposed about the inlet of the ignition tube and a pair of opposing directing devices disposed about an outlet of the ignition tube, wherein the pair of flow directing devices disposed about the inlet of the ignition tube are configured to direct the flow of the mixture of coal and air in the transport tube towards the inlet of the ignition tube, and wherein the pair of directing devices disposed about the outlet of the ignition tube are configured to direct any portion of the flow of the mixture of coal and air that avoids entering the inlet of the ignition tube towards the ignited flow of coal and air leaving the outlet of the ignition tube for blending therewith and subsequent ignition.

12. The system of claim 10, wherein the plurality of flow directing devices comprise venturi-shaped devices.

13. The system of claim 10, wherein the predetermined spacing between the portion of the laser tube disposed in the fuel transport tube and the ignition tube forms the recirculation zone where particles of coal in the mixture of coal and air carried in the fuel transport tube recirculate in the recirculation zone for more exposure to the beam of laser light prior to entering the ignition tube, wherein the particles of the coal absorb photons of the beam of laser light, and heat up to cause an initial ignition of some of the coal particles, and subsequent absorbing, heating, and ignition of other particles of coal in the recirculation zone.

14. The system of claim 13, wherein the multiple of ignition stages of the ignition tube comprises a flame initiation stage and a flame growth and propagation stage, wherein the flame initiation stage receives the coal particles from the recirculation zone for further irradiation by the beam of laser light, the further irradiation leading to combustion and flame generation, and wherein the flame growth and propagation stage receives the coal particles undergoing combustion and flame generation in the flame initiation stage for additional irradiation by the beam of laser light, the additional irradiation leading to further flame growth and propagation of the flame out from the ignition tube towards the furnace.

15. The system of claim 10, wherein an inner wall of the ignition tube comprises a plurality of ignition flow directing devices, wherein each of the ignition flow directing devices is configured to direct the flow of the mixture of the coal and air to concentrated locations within the ignition tube for irradiation by the beam of laser light received from the laser tube.

16. The system of claim 10, further comprising:

a plurality of sensors located about the fuel transport tube and the laser igniter, each of the sensors configured to detect operational conditions associated with the heating and ignition of the mixture of coal and air about the fuel transport tube and the laser igniter, wherein the;

control unit is configured to receive the detected operational conditions from the plurality of sensors and control the heating and ignition of the mixture of the coal and air by the laser igniter as a function of the detected operational conditions.

17. A method of igniting fuel for combustion in a burner assembly, comprising:

transporting a flow of a mixture of fuel from a fuel source and air from an air source to a furnace with a fuel transport tube;

directing a portion of the flow of the mixture of the fuel and air through an inlet of an ignition tube placed within the fuel transport tube;

directing a beam of laser light from a laser tube into the fuel transport tube towards the mixture of the fuel and air carried through the ignition tube;

heating and igniting the mixture of the fuel and air carried through the ignition tube in a multiple of stages;

supplying the heated and ignited mixture of the fuel and air from the ignition tube to the furnace; and reducing a velocity of air coming out of the laser tube to a velocity that is slower than a velocity of the flow of the mixture of fuel and air in the fuel transport tube, creating a recirculation zone in a region between an outlet of the laser tube and an inlet to the ignition tube, wherein the mixture of fuel and air carried in the fuel transport tube recirculates for more exposure in the recirculation zone to the beam of laser light prior to entering the ignition tube.

18. The method of claim 17, further comprising directing any portion of the flow of the mixture of the fuel and air that avoids entering the inlet of the ignition tube towards the ignited flow of fuel leaving an outlet of the ignition tube for blending therewith and subsequent ignition.

19. The method of claim 17, wherein the particles of the fuel in the recirculation zone absorb photons of the beam of laser light during recirculation, and heat up to cause an initial ignition of some of the particles, the initial ignition causing subsequent absorbing, heating, and ignition of other particles of fuel located about the inlet of the ignition tube.

20. The method of claim 19, wherein the heating and igniting of the fuel carried through the ignition tube in a multiple of stages comprises:

receiving the fuel particles after recirculating in a first stage of the ignition tube;

further irradiating the fuel particles by the beam of laser light in the first stage of the ignition tube, the further irradiation leading to combustion and flame generation;

receiving the fuel particles undergoing combustion and flame generation in a second stage of the ignition tube; and additional irradiating of the fuel particles undergoing combustion and flame generation in the second stage of the ignition tube by the beam of laser light, the additional irradiation leading to further flame growth and propagation.

* * * * *